US007225124B2

(12) United States Patent
Deligne et al.

(10) Patent No.: US 7,225,124 B2
(45) Date of Patent: May 29, 2007

(54) METHODS AND APPARATUS FOR MULTIPLE SOURCE SIGNAL SEPARATION

(75) Inventors: Sabine V. Deligne, New York, NY (US); Satyanarayana Dharanipragada, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 836 days.

(21) Appl. No.: 10/315,680

(22) Filed: Dec. 10, 2002

(65) Prior Publication Data

US 2004/0111260 A1 Jun. 10, 2004

(51) Int. Cl.
*G10L 21/00* (2006.01)

(52) U.S. Cl. ..... 704/233

(58) Field of Classification Search ..... 704/233
See application file for complete search history.

(56) References Cited

U.S. PATENT DOCUMENTS

| | | | | |
|---|---|---|---|---|
| 4,209,843 | A * | 6/1980 | Hyatt | 708/422 |
| 6,577,675 | B2 * | 6/2003 | Lindgren et al. | 375/148 |
| 7,116,271 | B2 * | 10/2006 | Kostanic et al. | 342/378 |

FOREIGN PATENT DOCUMENTS

JP 2000-242624 9/2000

OTHER PUBLICATIONS

J.F. Cardoso, "Blind Signal Separation Statistical Principles," Proceedings of the IEEE, vol. 9, pp. 1-16, Oct. 1998.

A. Acero et al., "Speech/Noise Separation Using Two Microphones and a VQ Model of Speech Signals," Proceedings of ICSLP 2000, 4 pages, 2000.

L. Rabiner et al., "Fundamentals of Speech Recognition," Chapter 3, Prentice Hall Signal Processing Series, pp. 69-117, 1993.

S. Deligne et al., "Robust Speech Recognition with Multi-Channel Codebook Dependent Cepstral Normalization (MCDCN)," Proceedings of ASRU2001, 4 pages, 2001.

M.J.F. Gales et al., "Robust Continuous Speech Recognition Using Parallel Model Combination," IEEE Transactions on Speech and Audio Processing, vol. 4, pp. 1-14, 1996.

L.R. Bahl et al., "Performance of the IBM Large Vocabulary Continuous Speech Recognition System on the ARPA Wall Street Journal Task," Proceedings of ICASSP 1995, vol. 1, pp. 41-44, 1995.

S. Deligne et al., "A Robust High Accuracy Speech Recognition System for Mobile Applications," IEEE Transactions on Speech and Audio Processing, vol. 10, No. 8, pp. 551-561, Nov. 2002.

(Continued)

*Primary Examiner*—Susan McFadden
(74) *Attorney, Agent, or Firm*—Anne V. Dougherty; Ryan, Mason & Lewis, LLP

(57) ABSTRACT

A technique for separating a signal associated with a first source from a mixture of the first source signal and a signal associated with a second source comprises the following steps/operations. First, two signals respectively representative of two mixtures of the first source signal and the second source signal are obtained. Then, the first source signal is separated from the mixture in a non-linear signal domain using the two mixture signals and at least one known statistical property associated with the first source and the second source, and without a need to use a reference signal.

31 Claims, 4 Drawing Sheets

OTHER PUBLICATIONS

M. Aoki et al., "Sound Source Segregation Based on Estimating Incident Angle of Each Frequency Component of Input Signals Acquired by Multiple Microphones," Acoustic Science & Tech., vol. 22, No. 2, pp. 149-157, Oct. 2001 (English Version).

M. Aoki et al., "Sound Source Segregation Based on Estimating Incident Angle of Each Frequency Component of Input Signals Acquired by Multiple Microphones," Acoustic Science & Tech., vol. 22, No. 2, 2 pages, Oct. 2001 (English Abstract).

M. Aoki et al., "Sound Source Segregation Based on Estimating Incident Angle of Each Frequency Component of Input Signals Acquired by Multiple Microphones," Acoustic Science & Tech., vol. 22, No. 2, pp. 45-46, Oct. 2001 (Japanese Version).

S. Choi et al., "Flexible Independent Component Analysis," Neural Networks for Signal Processing VIII, Proceedings of the 1998 IEEE Signal Processing Society Workshop, pp. 83-92, Aug. 1998.

* cited by examiner

METHODS AND APPARATUS FOR MULTIPLE SOURCE SIGNAL SEPARATION

FIELD OF THE INVENTION

The present invention generally relates to source separation techniques and, more particularly, to techniques for separating non-linear mixtures of sources where some statistical property of each source is known, for example, the probability density function of each source is modeled with a known mixture of Gaussians.

BACKGROUND OF THE INVENTION

Source separation addresses the issue of recovering source signals from the observation of distinct mixtures of these sources. Conventional approaches to source separation typically assume that the sources are linearly mixed. Also, conventional approaches to source separation are usually blind in the sense that they assume that no detailed information (or nearly no detailed information in a semi-blind approach) about the statistical properties of the sources is known and can be explicitly taken advantage of in the separation process. The approach disclosed in J. F. Cardoso, "Blind Signal Separation: Statistical Principles," Proceedings of the IEEE, pp. 2009–2025, vol. 9, Oct. 1998, the disclosure of which is incorporated by reference herein, is an example of a source separation approach that assumes a linear mixture and that is blind.

An approach disclosed in A. Acero et al., "Speech/Noise Separation Using Two Microphones and a VQ Model of Speech Signals," Proceedings of ICSLP 2000, the disclosure of which is incorporated by reference herein, proposes a source separation technique that uses a priori information about the probability density function (pdf) of the sources. However, since the technique operates in the Linear Predictive Coefficient (LPC) domain which results from a linear transformation of the waveform domain, the technique assumes that the observed mixture is linear. Therefore, the technique can not be used in the case of non-linear mixtures.

However, there are cases where the observed mixtures are not linear and where a priori information about the statistical properties of the sources is reliably available. This is the case, for example, in speech applications requiring the separation of mixed audio sources. Examples of such speech applications may be speech recognition in the presence of competing speech, interfering music or specific noise sources, e.g., car or street noise.

Even though the audio sources can be assumed to be linearly mixed in the waveform domain, the linear mixtures of waveforms result in non-linear mixtures in the cepstral domain, which is the domain where speech applications usually operate. As is known, a cepstra is a vector that is computed by the front end of a speech recognition system from the log-spectrum of a segment of speech waveform, see, e.g., L. Rabiner et al., "Fundamentals of Speech Recognition," chapter 3, Prentice Hall Signal Processing Series, 1993, the disclosure of which is incorporated by reference herein.

Because of this log-transformation, a linear mixture of waveform signals results in a non-linear mixture of cepstral signals. However, it is computationally advantageous in speech applications to perform source separation in the cepstral domain, rather than in the waveform domain. Indeed, the stream of cepstra corresponding to a speech utterance is computed from successive overlapping segments of the speech waveform. Segments are usually about 100 milliseconds (ms) long, and the shift between two adjacent segments is about 10 ms long. Therefore, a separation process operating in the cepstral domain on 11 kilo-Hertz (kHz) speech data only needs to be applied every 110 samples, as compared with the waveform domain where the separation process must be applied every sample.

Further, the pdf of speech, as well as the pdf of many possible interfering audio signals (e.g., competing speech, music, specific noise sources, etc.), can be reliably modeled in the cepstral domain and integrated in the separation process. The pdf of speech in the cepstral domain is estimated for recognition purposes, and the pdf of the interfering sources can be estimated off-line on representative sets of data collected from similar sources.

An approach disclosed in S. Deligne and R. Gopinath, "Robust Speech Recognition with Multi-channel Codebook Dependent Cepstral Normalization (MCDCN)," Proceedings of ASRU2001, 2001, the disclosure of which is incorporated by reference herein, proposes a source separation technique that integrates a priori information about the pdf of at least one of the sources, and that does not assume a linear mixture. In this approach, unwanted source signals interfere with a desired source signal. It is assumed that a mixture of the desired signal and of the interfering signals is recorded in one channel, while the interfering signals alone (i.e., without the desired signal) are recorded in a second channel, forming a so-called reference signal. In many cases, however, a reference signal is not available. For example, in the context of an automotive speech recognition application with competing speech from the car passengers, it is not possible to separately capture the speech of the user of the speech recognition system (e.g., the driver) and the competing speech of the other passengers in the car.

Accordingly, there is a need for source separation techniques which overcome the shortcomings and disadvantages associated with conventional source separation techniques.

SUMMARY OF THE INVENTION

The present invention provides improved source separation techniques. In one aspect of the invention, a technique for separating a signal associated with a first source from a mixture of the first source signal and a signal associated with a second source comprises the following steps/operations. First, two signals respectively representative of two mixtures of the first source signal and the second source signal are obtained. Then, the first source signal is separated from the mixture in a non-linear signal domain using the two mixture signals and at least one known statistical property associated with the first source and the second source, and without a need to use a reference signal.

The two mixture signals obtained may respectively represent a non-weighted mixture of the first source signal and the second source signal and a weighted mixture of the first source signal and the second source signal. The separation step/operation may be performed in the non-linear domain by converting the non-weighted mixture signal into a first cepstral mixture signal and converting the weighted mixture signal into a second cepstral mixture signal.

Thus, the separation step/operation may further comprise iteratively generating an estimate of the second source signal based on the second cepstral mixture signal and an estimate of the first source signal from a previous iteration of the separation step. Preferably, the step/operation of generating the estimate of the second source signal assumes that the second source signal is modeled with a mixture of Gaussians.

Further, the separation step/operation may further comprise iteratively generating an estimate of the first source signal based on the first cepstral mixture signal and the estimate of the second source signal. Preferably, the step/operation of generating the estimate of the first source signal assumes that the first source signal is modeled with a mixture of Gaussians.

After the separation process, the separated first source signal may be subsequently used by a signal processing application, e.g., a speech recognition application. Further, in a speech processing application, the first source signal may be a speech signal and the second source signal may be a signal representing at least one of competing speech, interfering music and a specific noise source.

These and other objects, features and advantages of the present invention will become apparent from the following detailed description of illustrative embodiments thereof, which is to be read in connection with the accompanying drawings.

DESCRIPTION OF THE PREFERRED EMBODIMENTS

Figure 1:
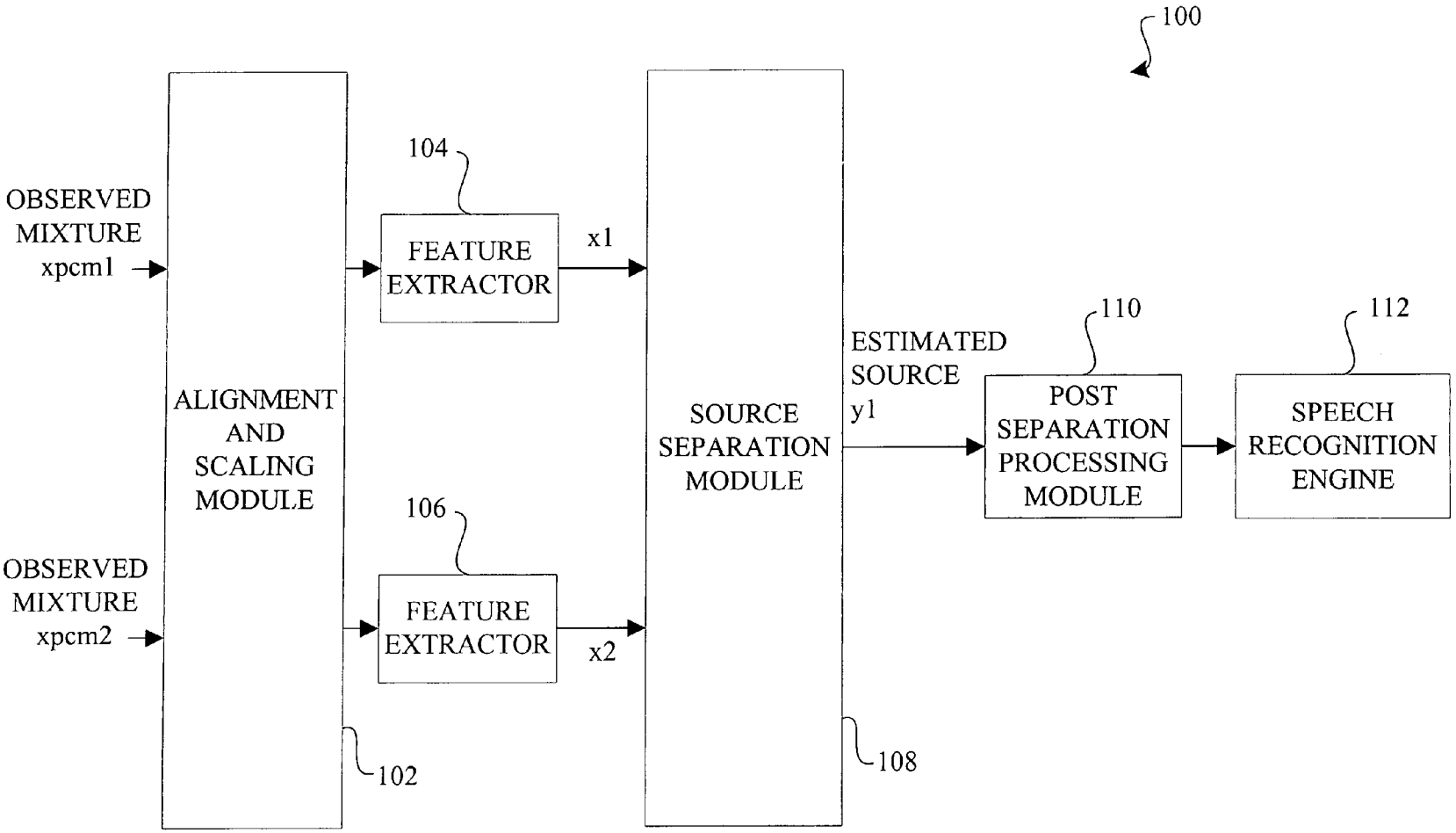
FIG. 1 is a block diagram illustrating integration of a source separation process in a speech recognition system in accordance with an embodiment of the present invention.

The present invention will be explained below in the context of an illustrative speech recognition application. Further, the illustrative speech recognition application is considered to be "codebook dependent." It is to be understood that the phrase "codebook dependent" refers to the use of a mixture of Gaussians to model the probability density function of each source signal. The codebook associated to a source signal comprises a collection of codewords characterizing this source signal. Each codeword is specified by its prior probability and by the parameters of a Gaussian distribution: a mean and a covariance matrix. In other words, a mixture of Gaussians is equivalent to a codebook.

However, it is to be further understood that the present invention is not limited to this or any particular application. Rather, the invention is more generally applicable to any application in which it is desirable to perform a source separation process which does not assume a linear mixing of sources, which assumes at least one statistical property of the sources is known, and which does not require a reference signal.

Thus, before explaining the source separation process of the invention in a speech recognition context, source separation principles of the invention will first be generally explained.

Assume that ypcm1 and ypcm2 are two waveform signals that are linearly mixed, resulting into two mixtures xpcm1 and xpcm2 according to xpcm1=ypcm1+ypcm2, and xpcm2=a ypcm1+ypcm2, such that a <1. Assume that yf1 and yf2 are the spectra of the signals ypcm1 and ypcm2, respectively, and that xf1 and xf2 are the spectra of the signals xpcm1 and xpcm2, respectively.

Further assume that y1, y2, x1 and x2 are the cepstral signals corresponding to yf1, yf2, xf1, xf2, respectively, according to y1=C log(yf1), y2=C log(yf2), x1=C log(xf1), x2=C log(xf2), where C refers to the Discrete Cosine Transform. Thus, it may be stated that:

$$y1=x1-g(y1,\ y2,\ 1) \tag{1}$$

$$y2=x2-g(y2,\ y1,\ a) \tag{2}$$

where g(u, v, w)=C log(1+w exp(invC (v−u))) and where invC refers to the inverse Discrete Cosine Transform.

Since y1 in equation (1) is unknown, the value of the function g is approximated by its expected value over y1: Ey1 [g(y1, y2, 1)|y2], where the expectation is computed with reference to a mixture of Gaussians modeling the pdf of y1. Also, since y2 in equation (2) is unknown, the value of the function g is approximated by its expected value over y2: Ey2[g(y2, y1, a)|y1]), where the expectation is computed with reference to a mixture of Gaussians modeling the pdf of y2. Replacing the value of the function g in equations (1) and (2) by the corresponding expected values of g, estimates y2(k) and y1(k) of y2 and y1, respectively, are alternately computed at each iteration (k) of an iterative procedure as follows:

Initialization:

$$y1(0)=x1$$

Iteration n (n≧1):

$$y2(n)=x2-Ey2[g(y2,\ y1,\ a)|y1=y1(n-1)]$$

$$y1(n)=x1-Ey1[g(y1,\ y2,\ 1)|y2=y2(n)]$$

$$n=n+1$$

Given the source separation principles of the invention generally explained above, a source separation process of the invention in a speech recognition context will now be explained.

Referring initially to FIG. 1, a block diagram illustrates integration of a source separation process in a speech recognition system in accordance with an embodiment of the present invention. As shown, a speech recognition system 100 comprises an alignment and scaling module 102, first and second feature extractors 104 and 106, a source separation module 108, a post separation processing module 110, and a speech recognition engine 112.

First, observed waveform mixtures xpcm1 and xpcm2 are aligned and scaled in the alignment and scaling module 102 to compensate for the delays and attenuations introduced during propagation of the signals to the sensors which captured the signals, e.g., a microphone (not shown) associated with the speech recognition system. Such alignment and scaling operations are well known in the speech signal processing art. Any suitable alignment and scaling technique may be employed.

Next, cepstral features are extracted in first and second feature extractors 104 and 106 from the aligned and scaled waveform mixtures xpcm1 and xpcm2, respectively. Techniques for cepstral feature extraction are well known in the speech signal processing art. Any suitable extraction technique may be employed.

The cepstral mixtures x1 and x2 output by feature extractors 104 and 106, respectively, are then separated by the source separation module 108 in accordance with the present invention. It is to be appreciated that the output of the source separation module 108 is preferably the estimate of the desired source to which speech recognition is to be applied, e.g., in this case, estimated source signal y1. An illustrative source separation process which may be implemented by the source separation module 108 will be described in detail below in the context of FIGS. 2A and 2B.

The enhanced cepstral features output by the source separation module 108, e.g., associated with estimated source signal y1, are then normalized and further processed in post separation processing module 110. Examples of processing techniques that may be performed in module 110 include, but are not limited to, computing and appending to the vector of cepstral features its first and second order temporal derivatives, also referred to as dynamic features or delta and delta-delta cepstral features, as these dynamic features carry information on the temporal structure of speech, see, e.g., chapter 3 in the above-mentioned Rabiner et al. reference.

Lastly, estimated source signal y1 is sent to the speech recognition engine 112 for decoding. Techniques for performing speech recognition are well known in the speech signal processing art. Any suitable recognition technique may be employed.

Figure 2A:
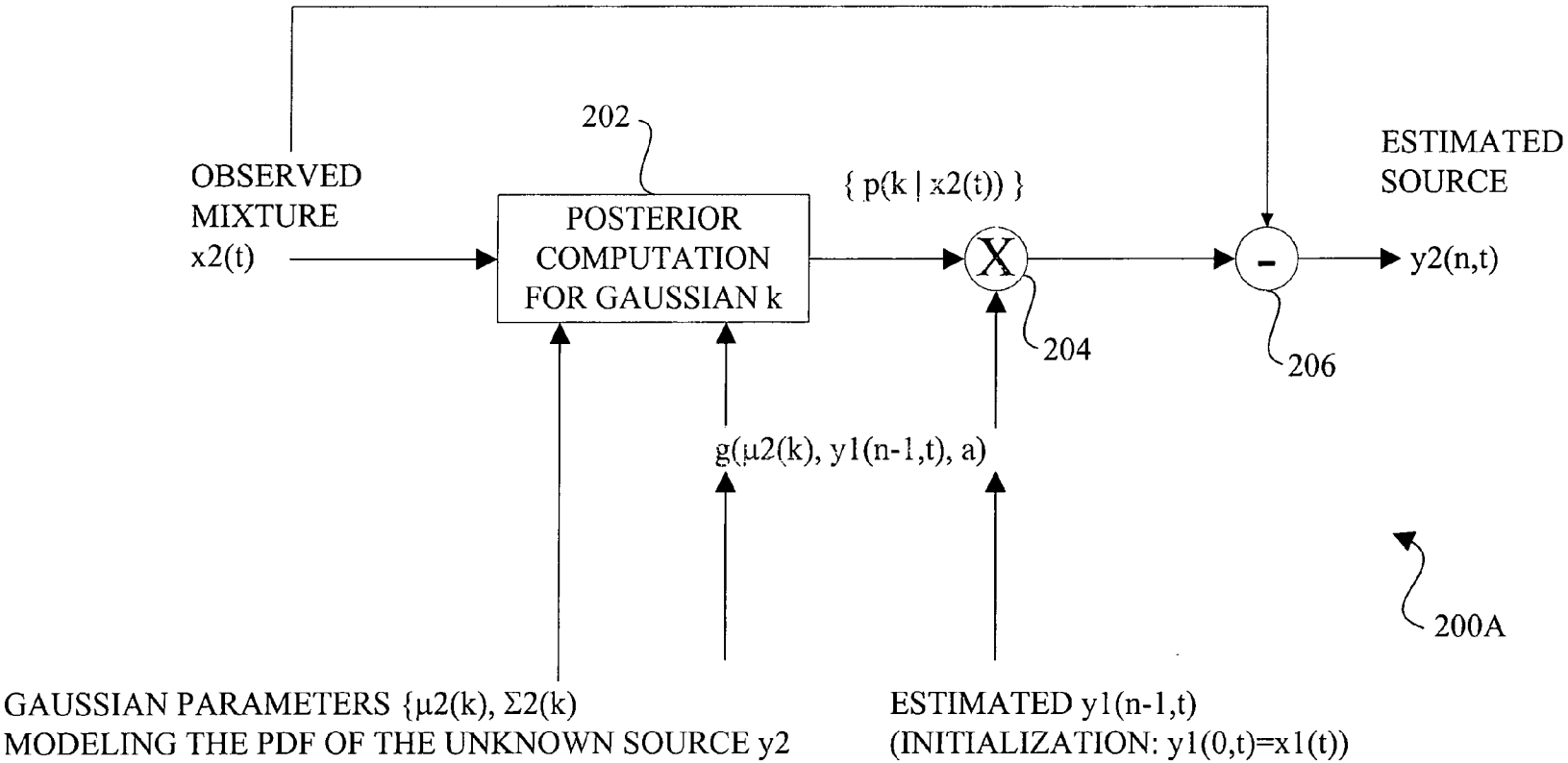
FIG. 2A is a flow diagram illustrating a first portion of a source separation process in accordance with an embodiment of the present invention.
Figure 2B:
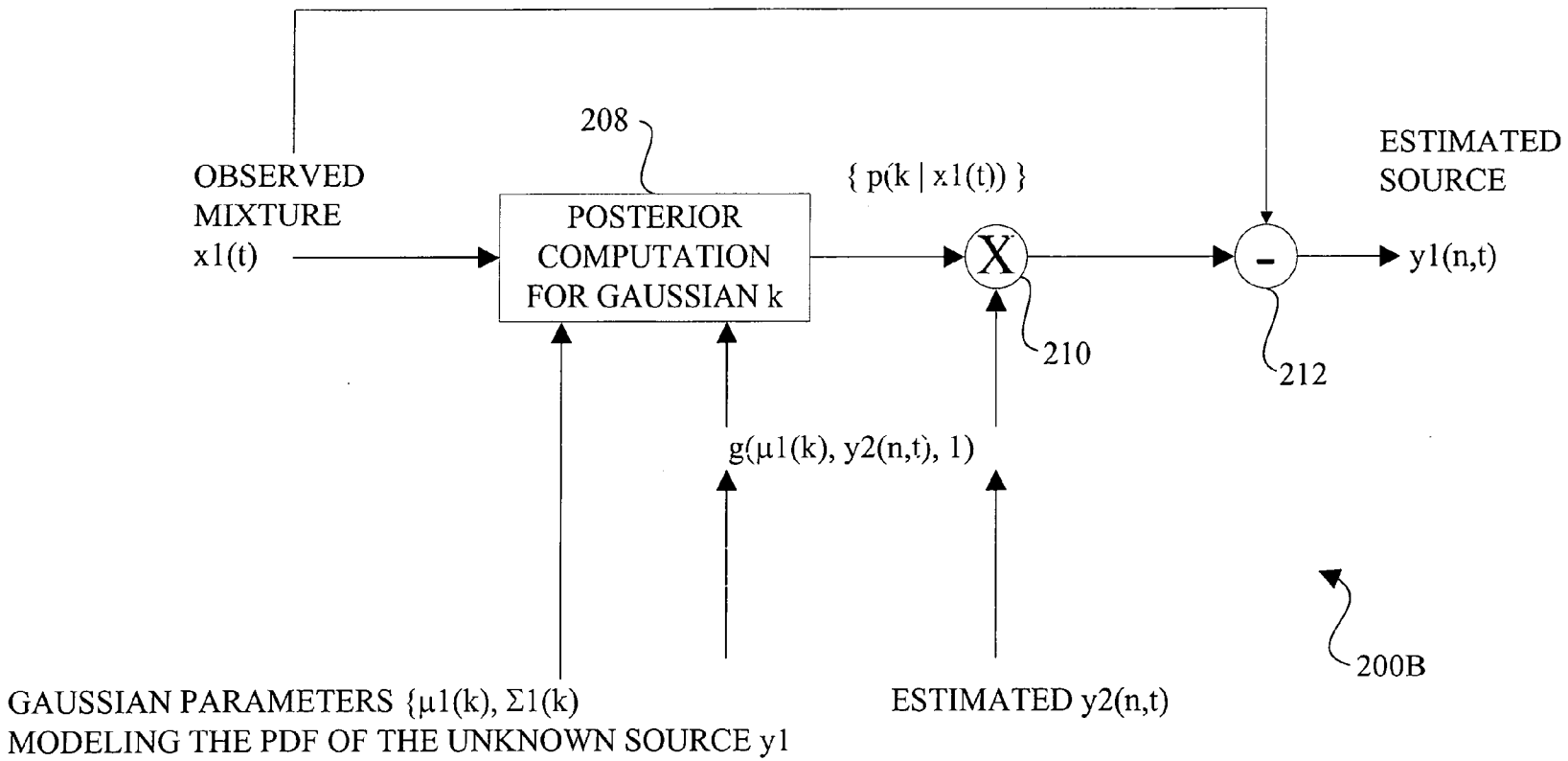
FIG. 2B is a flow diagram illustrating a second portion of a source separation process in accordance with an embodiment of the present invention.

Referring now to FIGS. 2A and 2B, flow diagrams illustrate first and second portions, respectively, of a source separation process in accordance with an embodiment of the present invention. More particularly, FIGS. 2A and 2B illustrate, respectively, the two steps forming each iteration of a source separation process according to an embodiment of the invention.

First, the process is initialized by setting y1(0, t) equal to the observed mixture at time t, x1(t): y1(0,t)=x1(t) for each time index t.

As shown in FIG. 2A, the first step 200A of iteration n, n≧1, comprises computing an estimate y2(n,t) of the source y2 at time (t) from the observed mixture x2 and from the estimated value y1(n−1,t) (where y1(0,t) is initialized with x1(t)) by assuming that the pdf of the random variable y2 is modeled with a mixture of K Gaussians N(μ2k, Σ2k) with k=1 to K (where N refers to the Gaussian pdf of mean μ2k and variance Σ2k). The step may be represented as:

$$y2(n,t)=x2(t)-\Sigma_k p(k|x2(t))g(\mu 2k,y1(n-1,\ t),\ a) \tag{3}$$

where p(k|x2(t) ) is computed in sub-step 202 (posterior computation for Gaussian k) by assuming that the random variable x2 follows the Gaussian distribution N(μ2k+g(μ2k, y1(n−1,t), a), Ξ2k(n,t)) where Ξ2k(n,t) is computed so as to approximate the variance of the random variable x2, and where g(u, v, w)=C log(1+w exp(invC (v−u))). Sub-step 204 performs the multiplication of p(k|x2(t)) with g(μ2k, y1(n−1,t), a), while sub-step 206 performs the subtraction of x2(t) and $\Sigma_k$ p(k|x2(t)) g(μ2k, y1(n−1,t), a). The result is the estimated source y2(n,t).

As shown in FIG. 2B, the second step 200B of iteration n, n≧1, comprises computing an estimate y1(n,t) of the source y1 at time (t) from the observed mixture x1 and from the estimated value y2(n,t) by assuming that the pdf of the random variable y1 is modeled with a mixture of K Gaussians N(μ1k, Σ1k) with k=1 to K (where N refers to the Gaussian pdf of mean μ1k and variance Σ1k). The step may be represented as:

$$y1(n,t)=x1(t)-\Sigma_k p(k|x1(t))g(\mu 1k,\ y2(n,t),\ 1) \tag{4}$$

where p(k|x1(t)) is computed in sub-step 208 (posterior computation for Gaussian k) by assuming that the random variable x1 follows the Gaussian distribution N(μ1k+g(μ1k, y2(n,t), 1), Ξ1k(n,t)) where Ξ1k(n,t) is computed so as to approximate the variance of the random variable x1, and where g(u, v, w)=C log(1+w exp(invC (v−u))). Sub-step 210 performs the multiplication of p(k|x1(t)) with g(μ1k, y2(n,t), 1), while sub-step 212 performs the subtraction of x1(t) and $\Sigma_k$ p(k|x1(t)) g(μ1k, y2(n,t), 1). The result is the estimated source y1(n,t)

After M iterations are performed (M1), the estimated stream of T cepstral feature vectors y1(M,t), with t=1 to T, is sent to the speech recognition engine for decoding. The estimated stream of T cepstral feature vectors y2(M,t), with t=1 to T, is discarded as it is not to be decoded. The stream of data y1 is determined to be the source that is to be decoded based on the relative locations of the microphones capturing the streams x1 and x2. The microphone which is located closer to the speech source that is to be decoded captures the signal x1. The microphone which is located further away from the speech source that is to be decoded captures the signal x2.

Further elaborating now on the above-described illustrative source separation process of the invention, as pointed out above, the source separation process estimates the covariance matrices Ξ1k(n,t) or Ξ2k(n,t) of the observed mixtures x1 and x2 that are used, respectively, at step 200A and step 200B of each iteration n. The covariance matrices Ξ1k(n,t) or Ξ2k(n,t) may be computed on-the-fly from the observed mixtures, or according to the Parallel Model Combination (PMC) equations defining the covariance matrix of a random variable resulting from the exponentiation of the sum of two log-Normally distributed random variables, see, e.g., M. J. F. Gales et al., "Robust Continuous Speech Recognition Using Parallel Model Combination," IEEE Transactions on Speech and Audio Processing, vol. 4, 1996, the disclosure of which is incorporated by reference herein.

The PMC equations may be employed as follows. Assume that μ1 and Ξ1 are, respectively, the mean and the covariance matrix of a Gaussian random variable z1 in the cepstral domain. Assume that μ2 and Ξ2 are, respectively, the mean and the covariance matrix of a Gaussian random variable z2 in the cepstral domain. Assume that z1f=invC log(z1) and z2f=invC log(z2) are the random variables obtained by converting the random variables z1 and z2 into the spectral domain. Assume that zf=z1f+z2f is the sum of the random variables z1f and z2f. Then, the PMC equations allow to compute the covariance matrix Ξ of the random variable z=C log(zf) obtained by converting the random variable zf into the cepstral domain as: $\Xi_{ij}=\log[((\Xi 1f_{ij}+\Xi 2f_{ij})/((\mu 1f_i+\mu 2f_i)(\mu 1f_j+\mu 2f_j)))+1]$ where $\Xi 1f_{ij}$ (resp., $\Xi 2f_{ij}$) denotes the $(i,j)^{th}$ element in the covariance matrix Ξ1f (resp., Ξ2f) defined as $\Xi 1f_{ij}=\mu 1f_j\ (\exp(\Xi 1_{ij})-1)$ (resp., $\Xi 2f_{ij}=\mu 2f_i{*}\ \mu 2f_j\ (\exp(\Xi 2_{ij})-1)$), where $\mu 1f_i$ (resp., $\mu 2f_i$) refers to the $i^{th}$ dimension of vector μ1f (resp., μ2f), and where $\mu 1f_i=\exp(\mu 1_i+(\Xi 1_{ii}/2))$ (resp., $\mu 2f_i=\exp(\mu 2+(\Xi 2_{ii}/2))$).

As will be seen below, in experiments where the speech of various speakers is mixed with car noise, the pdf of the speech source is modeled with a mixture of 32 Gaussians, and the pdf of the noise source is modeled with a mixture of two Gaussians. As far as the test data are concerned, a mixture of 32 Gaussians for speech and a mixture of two Gaussians for noise appears to correspond to a good tradeoff between recognition accuracy and complexity. Sources with more complex pdfs may involve mixtures with more Gaussians.

Figure 3:
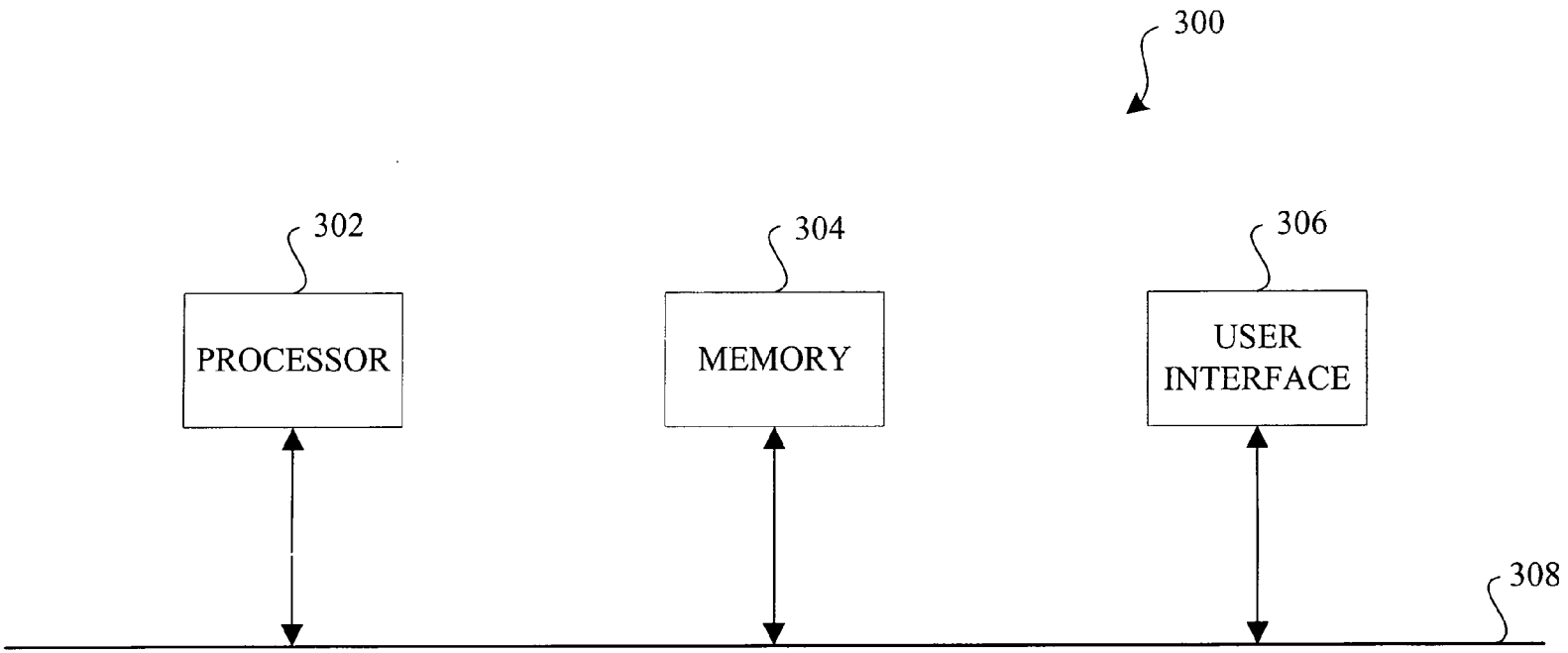
FIG. 3 is a block diagram illustrating an exemplary implementation of a speech recognition system incorporating a source separation process in accordance with an embodiment of the present invention.

Referring lastly to FIG. 3, a block diagram illustrates an exemplary implementation of a speech recognition system incorporating a source separation process in accordance with an embodiment of the present invention (e.g., as illustrated in FIGS. 1, 2A and 2B). In this particular implementation 300, a processor 302 for controlling and performing the operations described herein (e.g., alignment, scaling, feature extraction, source separation, post separation processing, and speech recognition) is coupled to memory 304 and user interface 306 via computer bus 308.

It is to be appreciated that the term "processor" as used herein is intended to include any processing device, such as, for example, one that includes a CPU (central processing unit) and/or other suitable processing circuitry. For example, the processor may be a digital signal processor, as is known in the art. Also the term "processor" may refer to more than one individual processor. The term "memory" as used herein is intended to include memory associated with a processor or CPU, such as, for example, RAM, ROM, a fixed memory device (e.g., hard drive), a removable memory device (e.g., diskette), etc. In addition, the term "user interface" as used herein is intended to include, for example, a microphone for inputting speech data to the processing unit and preferably a visual display for presenting results associated with the speech recognition process.

Accordingly, computer software including instructions or code for performing the methodologies of the invention, as described herein, may be stored in one or more of the associated memory devices (e.g., ROM, fixed or removable memory) and, when ready to be utilized, loaded in part or in whole (e.g., into RAM) and executed by a CPU.

In any case, it should be understood that the elements illustrated in FIGS. 1, 2A and 2B may be implemented in various forms of hardware, software, or combinations thereof, e.g., one or more digital signal processors with associated memory, application specific integrated circuit(s), functional circuitry, one or more appropriately programmed general purpose digital computers with associated memory, etc. Further, the methodologies of the invention may be embodied in a machine readable medium containing one or more programs which when executed implement the steps of the inventive methodologies. Given the teachings of the invention provided herein, one of ordinary skill in the related art will be able to contemplate other implementations of the elements of the invention.

An illustrative evaluation will now be provided of an embodiment of the invention as employed in the context of speech recognition, where the signal mixed with the speech is car noise. The evaluation protocol is first explained, and then the recognition scores obtained in accordance with a source separation process of the invention (referred to below as "codebook dependent source separation" or "CDSS") are compared to the scores obtained without any separation process, and also to the scores obtained with the above-mentioned MCDCN process.

The experiments are performed on a corpus of 12 male and female subjects uttering connected digit sequences in a non-moving car. A noise signal pre-recorded in a car at 60 mph is artificially added to the speech signal weighted by a factor of either one or "a," thus resulting in two distinct linear mixtures of speech and noise waveforms ("ypcm1+ypcm2" and "a ypcm1+ypcm2" as described above, where ypcm1 refers here to the speech waveform and ypcm2 to the noise waveform). Experiments are run with the factor "a" set to 0.3, 0.4 and 0.5. All recordings of speech and of noise are done at 22 kHz with an AKG Q400 microphone and down-sampled to 11 kHz.

In order to model the pdf of the speech source, a mixture of 32 Gaussians was estimated (prior to experimentation) on a collection of a few thousand sentences uttered by both males and females and recorded with an AKG Q400 microphone in a non-moving car and in a non-noisy environment, using the same setup as for the test data. In order to model the pdf of car noise, mixtures of two Gaussians were estimated (prior to experimentation) on about four minutes of noise recorded with an AKG Q400 microphone in a car at 60 mph, using the same setup as for the test data.

The mixture of speech and noise that is decoded by the speech recognition engine is either: (A) not separated; (B) separated with the MCDCN process; or (C) separated with the CDSS process. The performances of the speech recognition engine obtained with A, B and C are compared in terms of Word Error Rates (WER).

The speech recognition engine used in the experiments is particularly configured to be used in portable devices, or in automotive applications. The engine includes a set of speaker-independent acoustic models (156 subphones covering the phonetics of English) with about 10,000 context-dependent Gaussians, i.e., triphone contexts tied by using a decision tree (see L.R. Bahl et al., "Performance of the IBM Large Vocabulary Continuous Speech Recognition System on the ARPA Wall Street Journal Task," Proceedings of ICASSP 1995, vol. 1, pp. 41–44, 1995, the disclosure of which is incorporated by reference herein), trained on a few hundred hours of general English speech (about half of these training data has either digitally added car noise, or was recorded in a moving car at 30 and 60 mph). The front end of the system computes 12 cepstra+the energy+delta and delta-delta coefficients from 15 ms frames using 24 mel-filter banks (see, e.g., chapter 3 in the above-mentioned Rabiner et al. reference).

The CDSS process is applied as generally described above, and preferably as illustratively described above in connection with FIGS. 1, 2A and 2B.

Table 1 below shows the Word Error Rates (WER) obtained after decoding the test data. The WER obtained on the clean speech before addition of noise is 1.53% (percent). The WER obtained on the noisy speech after addition of noise (mixture "yf1+yf2") and without using any separation process is 12.31%. The WER obtained after using the MCDCN process using the second mixture ("a yf1+yf2") as the reference signal is given for various values of the mixing factor "a." MCDCN provides a reduction of the WER when the leakage of speech in the reference signal is low (a=0.3), but its performance degrades as the leakage is more important and for a factor "a" equal to 0.5, the MCDCN process is worse than the baseline WER of 12.31%. On the other hand, the CDSS process significantly improves the baseline WER for all the experimental values of the factor "a."

TABLE 1

| Word Error Rate | | | |
|---|---|---|---|
| Original speech | 1.53 | | |
| Noisy speech, no separation | 12.31 | | |
| | a = 0.3 | a = 0.4 | a = 0.5 |
| Noisy speech, MCDCN | 7.86 | 10.00 | 15.51 |
| Noisy speech, CDSS | 6.35 | 6.87 | 7.59 |

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method of separating a signal associated with a first source from a mixture of the first source signal and a signal associated with a second source, the method comprising the steps of:

obtaining two audio-related signals respectively representative of two mixtures of the first source signal and the second source signal; and separating the first source signal from the second source signal in a non-linear signal domain using the two mixture signals and at least one known statistical property associated with the first source and the second source, and without a need to use a reference signal; and outputting, at least, the separated first source signal.

2. The method of claim 1, wherein the two mixture signals obtained respectively represent a non-weighted mixture of the first source signal and the second source signal and a weighted mixture of the first source signal and the second source signal.

3. The method of claim 2, wherein the separation step is performed in the non-linear domain by converting the non-weighted mixture signal into a first cepstral mixture signal and converting the weighted mixture signal into a second cepstral mixture signal.

4. The method of claim 3, wherein the separation step further comprises the step of iteratively generating an estimate of the second source signal based on the second cepstral mixture signal and an estimate of the first source signal from a previous iteration of the separation step.

5. The method of claim 4, wherein the step of generating the estimate of the second source signal assumes that the second source signal is modeled with a mixture of Gaussians.

6. The method of claim 4, wherein the separation step further comprises the step of iteratively generating an estimate of the first source signal based on the first cepstral mixture signal and the estimate of the second source signal.

7. The method of claim 6, wherein the step of generating the estimate of the first source signal assumes that the first source signal is modeled with a mixture of Gaussians.

8. The method of claim 1, wherein the separated first source signal is subsequently used by a signal processing application.

9. The method of claim 8, wherein the application is speech recognition.

10. The method of claim 1, wherein the first source signal is a speech signal and the second source signal is a signal representing at least one of competing speech, interfering music and a specific noise source.

11. Apparatus for separating a signal associated with a first source from a mixture of the first source signal and a signal associated with a second source, the apparatus comprising:

a memory; and at least one processor, coupled to the memory, operative to: (i) obtain two audio-related signals respectively representative of two mixtures of the first source signal and the second source signal; and (ii) separate the first source signal from the second source signal in a non-linear signal domain using the two mixture signals and at least one known statistical property associated with the first source and the second source, and without a need to use a reference signal; and (iii) output, at least, the separated first source signal.

12. The apparatus of claim 11, wherein the two mixture signals obtained respectively represent a non-weighted mixture of the first source signal and the second source signal and a weighted mixture of the first source signal and the second source signal.

13. The apparatus of claim 12, wherein the separation operation is performed in the non-linear domain by converting the non-weighted mixture signal into a first cepstral mixture signal and converting the weighted mixture signal into a second cepstral mixture signal.

14. The apparatus of claim 13, wherein the separation operation further comprises iteratively generating an estimate of the second source signal based on the second cepstral mixture signal and an estimate of the first source signal from a previous iteration of the separation operation.

15. The apparatus of claim 14, wherein the operation of generating the estimate of the second source signal assumes that the second source signal is modeled with a mixture of Gaussians.

16. The apparatus of claim 14, wherein the separation operation further comprises iteratively generating an estimate of the first source signal based on the first cepstral mixture signal and the estimate of the second source signal.

17. The apparatus of claim 16, wherein the operation of generating the estimate of the first source signal assumes that the first source signal is modeled with a mixture of Gaussians.

18. The apparatus of claim 11, wherein the separated first source signal is subsequently used by a signal processing application.

19. The apparatus of claim 18, wherein the application is speech recognition.

20. The apparatus of claim 11, wherein the first source signal is a speech signal and the second source signal is a signal representing at least one of competing speech, interfering music and a specific noise source.

21. An article of manufacture for separating a signal associated with a first source from a mixture of the first source signal and a signal associated with a second source, comprising a machine readable medium containing one or more programs which when executed implement the steps of:

obtaining two audio-related signals respectively representative of two mixtures of the first source signal and the second source signal; and separating the first source signal from the second source signal in a non-linear signal domain using the two mixture signals and at least one known statistical property associated with the first source and the second source, and without a need to use a reference signal; and outputting, at least, the separated first source signal.

22. The article of claim 21, wherein the two mixture signals obtained respectively represent a non-weighted mixture of the first source signal and the second source signal and a weighted mixture of the first source signal and the second source signal.

23. The article of claim 22, wherein the separation step is performed in the non-linear domain by converting the non-weighted mixture signal into a first cepstral mixture signal and converting the weighted mixture signal into a second cepstral mixture signal.

24. The article of claim 23, wherein the separation step further comprises the step of iteratively generating an estimate of the second source signal based on the second cepstral mixture signal and an estimate of the first source signal from a previous iteration of the separation step.

25. The article of claim 24, wherein the step of generating the estimate of the second source signal assumes that the second source signal is modeled with a mixture of Gaussians.

26. The article of claim 24, wherein the separation step further comprises the step of iteratively generating an estimate of the first source signal based on the first cepstral mixture signal and the estimate of the second source signal.

27. The article of claim 26, wherein the step of generating the estimate of the first source signal assumes that the first source signal is modeled with a mixture of Gaussians.

28. The article of claim 21, wherein the separated first source signal is subsequently used by a signal processing application.

29. The article of claim 28, wherein the application is speech recognition.

30. The article of claim 21, wherein the first source signal is a speech signal and the second source signal is a signal representing at least one of competing speech, interfering music and a specific noise source.

31. Apparatus for separating a signal associated with a first source from a mixture of the first source signal and a signal associated with a second source, the apparatus comprising:

means for obtaining two audio-related signals respectively representative of two mixtures of the first source signal and the second source signal; and means, coupled to the signal obtaining means, for separating the first source signal from the second source signal in a non-liner signal domain using the two mixture signals and at least one known statistical property associated with the first source and the second source, and without a need to use a reference signal; and means, coupled to the separating means, for outputting, at least, the separated first source signal.

* * * * *

UNITED STATES PATENT AND TRADEMARK OFFICE

CERTIFICATE OF CORRECTION

PATENT NO. : 7,225,124 B2
APPLICATION NO. : 10/315680
DATED : May 29, 2007
INVENTOR(S) : S.V. Deligne et al.

It is certified that error appears in the above-identified patent and that said Letters Patent is hereby corrected as shown below:

Col. 6 line 51 please delete "defined as $\Xi 1f_{ij} = \mu 1f_j(\exp(\Xi l_{ij}) - 1)$" and insert --defined as $\Xi 1f_{ij} = \mu 1f_i * \mu 1f_j(\exp(\Xi l_{ij}) - 1)$--.

In the Claims:

Claim 1 Col. 9 line 8 please delete "and";

Claim 11 Col. 9 line 59 please delete the second occurrence of "and";

Claim 21 Col. 10 line 44 please delete "and";

Claim 31 Col. 12 line 7 please delete the second occurrence of "and".

Signed and Sealed this

Twenty-first Day of August, 2007

JON W. DUDAS
*Director of the United States Patent and Trademark Office*